US008637793B2

(12) United States Patent
Kwag et al.

(10) Patent No.: US 8,637,793 B2
(45) Date of Patent: Jan. 28, 2014

(54) ELECTRIC OVEN

(75) Inventors: Dong Seong Kwag, Seoul (KR); Hyeun Sik Nam, Seoul (KR); Wan Soo Kim, Seoul (KR); Seong Ho Cho, Seoul (KR); Jae Kyung Yang, Seoul (KR)

(73) Assignee: LG Electronics Inc., Seoul (KR)

( * ) Notice: Subject to any disclaimer, the term of this patent is extended or adjusted under 35 U.S.C. 154(b) by 1169 days.

(21) Appl. No.: 12/390,177

(22) Filed: Feb. 20, 2009

(65) Prior Publication Data

US 2009/0242542 A1 Oct. 1, 2009

(30) Foreign Application Priority Data

Apr. 1, 2008 (KR) ..... 10-2008-0030127

(51) Int. Cl.
*A21B 1/00* (2006.01)
*A21B 1/22* (2006.01)

(52) U.S. Cl.
USPC ..... 219/391

(58) Field of Classification Search
USPC ..... 219/391, 400, 399, 678, 757, 681; 126/273 R, 21 A, 299
See application file for complete search history.

(56) References Cited

U.S. PATENT DOCUMENTS

| | | | | |
|---|---|---|---|---|
| 7,180,041 | B2 * | 2/2007 | Song et al. | 219/757 |
| 7,847,224 | B2 * | 12/2010 | Song et al. | 219/757 |
| 2002/0084269 | A1 * | 7/2002 | Kim | 219/757 |
| 2006/0219234 | A1 * | 10/2006 | Larsen | 126/198 |

FOREIGN PATENT DOCUMENTS

| | | | |
|---|---|---|---|
| CN | 1363800 | A | 8/2002 |
| KR | 10-2006-0134384 | * | 12/2006 |

OTHER PUBLICATIONS

Machine translation of 10-2006-0134384, Apr. 2011.*

* cited by examiner

*Primary Examiner* — Henry Yuen
*Assistant Examiner* — Thomas Ward
(74) *Attorney, Agent, or Firm* — Birch, Stewart, Kolasch & Birch, LLP

(57) ABSTRACT

An electric oven has an air passage structure that is designed to effectively cool down electric components. The air passage structure quickly cools down a variety of electric components on a top surface of a cavity using air introduced from outside the oven. The oven has a series of passages and openings allowing the effective movement of air past the electric components and through the oven.

8 Claims, 5 Drawing Sheets

ELECTRIC OVEN

CROSS-REFERENCE TO RELATED APPLICATIONS

The present application claims priority under 35 U.S.C. 119 and 35 U.S.C. 365 to Korean Patent Application No. 10-2008-0030127 (filed on Apr. 1, 2008), which is hereby incorporated by reference in its entirety.

BACKGROUND

The present disclosure relates to a cooling structure of an electric oven.

An electric oven is generally used for baking or roasting food by heating the food using electricity. The electric oven is provided with a cooking chamber that is selectively opened and closed by a door. The electric oven includes electric components for generating microwaves and/or a heating source such as a heater for generating heat. Therefore, the food in the cooking chamber is cooked by the microwaves generated by the electric components and/or the heat generated by the heater.

In recent years, in order to maximizing a volume of the cooking chamber, a variety of electric components are installed above the cavity. In this case, the electric components, however, may be out of order or malfunction. In addition, airflow for dissipating heat generated in a space where the electric components are installed is not effectively realized and thus the electric components cannot be effectively cooled down.

SUMMARY

Embodiments provide an electric oven that is designed to be provided with an air passage that can enhance the cooling of a variety of electric components installed above a cavity.

In one embodiment, an electric oven includes a cavity defining a cooking chamber therein and an outer case enclosing the cavity. A supporting plate disposed between a top surface of the cavity and the outer case has a plurality of electric components. A control panel is mounted on a front end portions of the cavity and the outer case. A dividing member isolates a space formed above the supporting plate from a space formed under the supporting plate.

In another embodiment, an electric oven includes a cavity defining a cooking chamber and a door pivotally provided on a front surface of the cavity. An outer case encloses the cavity and has a side with an external air inlet. A supporting plate divides a space defined between a top surface of the cavity and a top surface of the outer case into first and second passages. The supporting plate is provided at an opposite edge to the external air inlet with a communication opening by which an airflow direction in the second passage intersects an airflow direction in the first passage.

In still another embodiment, an electric oven includes a cavity defining a cooking chamber and an outer case covering at least an upper portion of the cavity. A supporting plate is provided between the outer case and the cavity and on which electric components are installed. A fan assembly is provided at a downstream side of a first passage formed between the cavity and the supporting plate and a communication opening that is formed on the supporting plate to allow the first passage to communicate with a second passage defined between the supporting plate and the outer case.

According to the embodiments, a passage along which high temperature air discharged from the cooking chamber and high air used to cool down the door and a passage along which air for cooling down the components of the electric oven are separated from each other. Therefore, the components of the electric oven can be more effectively cooled down and thus endurance and operation reliability of the product can be improved.

The details of one or more embodiments are set forth in the accompanying drawings and the description below. Other features will be apparent from the description and drawings, and from the claims.

DETAILED DESCRIPTION OF THE EMBODIMENTS

Figure 1:
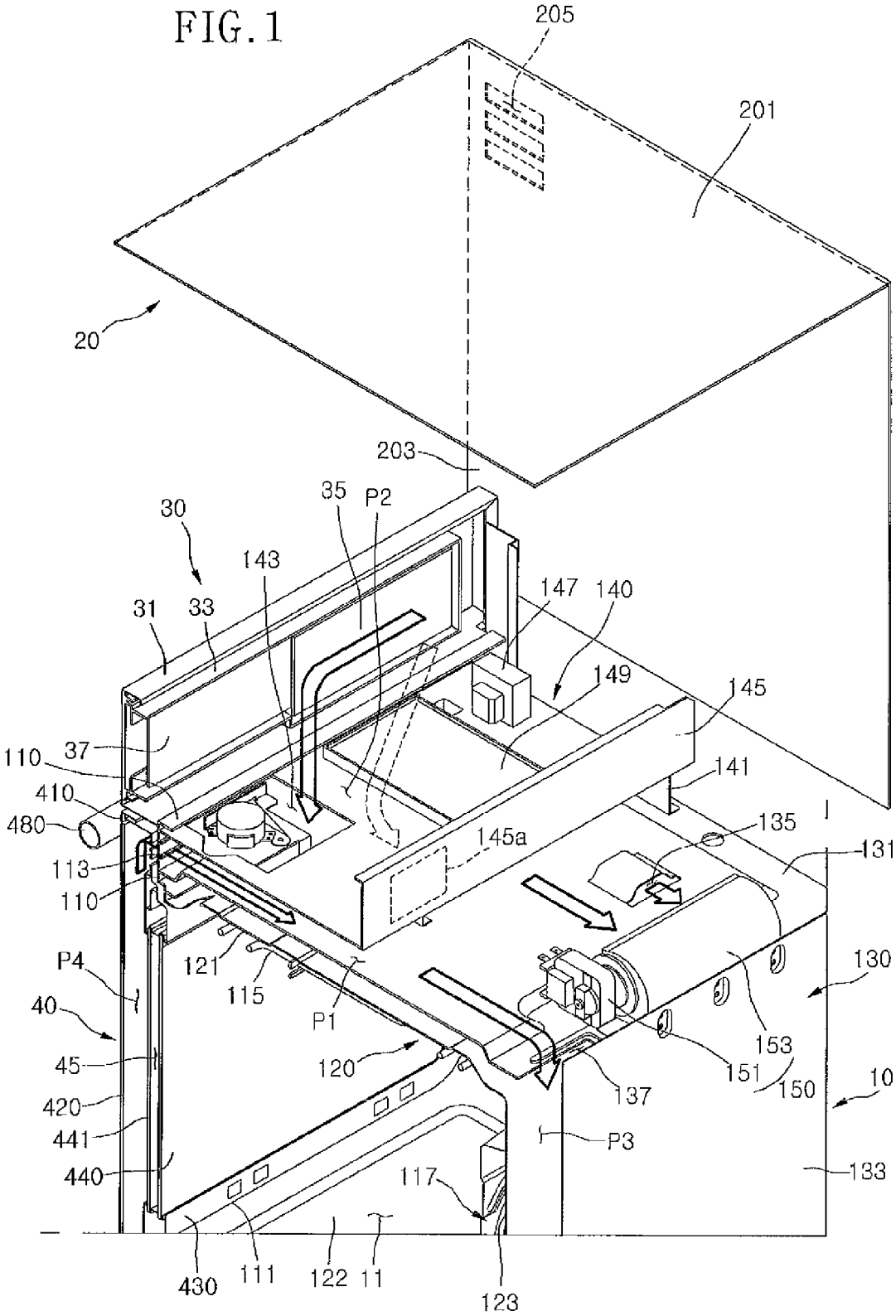
FIG. 1 is an exploded perspective view illustrating an internal structure of an electric oven.

Reference will now be made in detail to the embodiments of the present disclosure, examples of which are illustrated in the accompanying drawings;

FIG. 1 is an exploded perspective view illustrating an internal structure of an electric oven according to an embodiment.

Referring to FIG. 1, an electric oven includes a cavity 10, an outer case 20, a control panel 30, and a door 40. The cavity 10 defines a cooking chamber 11 in which food is cooked. The door 40 selectively opens and closes the cooking chamber 11. The outer case 20 defines top and both side surfaces of the electric oven. The control panel 30 receives a variety of manipulation signals for operating the electric oven to control the electric oven and displays a variety of information on the operation of the electric oven.

In addition, the cavity 10 includes a front plate 110, an inner cavity 120, and an outer cavity 130. In more detail, the front plate 110 defines a front surface of the cavity 10. The inner cavity 120 substantially defines top, bottom, both side and rear surfaces of the cooking chamber 11. That is, the inner cavity 120 includes an upper plate 121, a bottom plate 122, side plates, and back plates 123. The outer cavity 130 encloses the inner cavity 120 in a state where it is spaced apart from the inner cavity 120. That is, like the inner cavity 120, the outer cavity 130 includes an upper plate 131, a bottom plate, side plates, and a back plate 133.

Meanwhile, an opening 111 is defined by an inner circumference of the front plate 110 to load and withdraw the food in and from the cooking chamber 11. That is, a front surface of the front plate 110 has an opening 111 formed in a rectangular shape defined by a rectangular inner circumference of the front plate 110. A first air inlet 113 is formed on an upper end of the front plate 110 so that air flowing in the door can be directed to an outer-upper surface of the cavity 10. The front plate 110 covers front end portions of the inner cavity 120 and the outer cavity 130 and extends above the outer cavity 130. The first air inlet 113 is formed on a portion of the front plate 110, which is disposed above the outer cavity 130. An air outlet 43 of the door that will be described later is located in front of the first air inlet 113.

As previously described, since the outer cavity 130 is spaced apart from the inner cavity 120, an insulation layer may be formed between the inner and outer cavities 120 and 130. An insulation material may be filled in the insulation layer. For simplicity, the upper and back plates 121 and 123 of the inner cavity 120 will be respectively referred to as a first upper plate and a first back plate 123. In addition, the upper and back plates 131 and 133 of the outer cavity 130 will be referred to as a second upper plate 131 and a second back plate 133.

An opening communicating with the cooking chamber is formed on a portion of the first upper plate. The opening functions as an outlet through which air containing moisture generated from the food is exhausted to the outside.

An upper heater 115 and a convection unit 117 may be provided on an under surface of the first upper plate 121 and a front surface of the first back plate 123, respectively. The upper heater 115 functions to heat the food in the cooking chamber 11 using radiant heat and the convection unit 117 functions to heat the food in the cooking chamber 11 using convection heat.

Meanwhile, an opening 135 is formed on the second upper plate 131. While the opening 135 of the second upper plate 131 substantially communicates with the opening of the first upper plate 121. The opening 135 of the second upper plate 131 may be formed right above the opening of the first upper plate 121, the locations of the openings are not specifically limited. In more detail, the opening 135 functions as a passage through which the air exhausted through the opening of the first upper plate 121 flows along a first passage P1 that will be described later.

In addition, a plurality of second communication openings 137 are provided on a rear end portion of the second upper plate 131. The second communication openings 137 are formed by partly cutting the rear end portion of the second upper plate 131. The second communication openings 137 connect the first passage P1 to a third passage P3. The third passage P3 is formed between the first and second back plates 123 and 133.

Meanwhile, the outer case 20 includes a top plate 201 defining a top surface of the electric oven and two lateral plates 203 defining both side surfaces of the electric oven. Further, a predetermined space is defined between the top plate 201 and the second upper plate 131. In addition, one of the lateral plates 203 is provided with a second air inlet 205 through which external air is introduced. The external air introduced through the second air inlet 205 flows along a second passage P2 formed between the top plate 201 and a supporting plate 140.

The supporting plate 140 is provided in a space defined between the second upper plate 131 and the top plate 201. The supporting plate 140 is spaced apart from the second upper plate 131 to define a part of the first passage P1. An upper portion of the supporting plate 140 is covered by the top plate 210 to define the second passage P2. In addition, the supporting plate 140 has a shorter front-rear length than the second upper plate 131 or the top plate 201.

According to the above-described structure, an upstream side of the first passage P1 communicates with a door air outlet 43 and a downstream side of the first passage P1 communicates with the second communication openings 137. An upstream side of the second passage P2 communicates with the second air inlet 205. Therefore, the air introduced through the door air outlet 43 flows along the first passage P1 and the external air introduced through the second air inlet 20 flows along the second passage P2.

Meanwhile, supporting portions 141 extend from opposite side end portions of the supporting plates 140. The supporting portions 141 may be formed by portions of the opposite side end portions that are bent. Lower ends of the supporting portions 141 are respectively fixed on opposite top-side end portions of the second upper plate 131. A first communication opening 143 is formed on a side of the supporting plate 140. The first communication opening 143 functions as a passage connecting the first passage P1 to the second passage P2. Therefore, the air flowing along the second passage P2 is joined with the air flowing along the passage P1 through the first communication opening 143.

Here, the first communication opening 143 may be formed on an opposite side to the second air inlet 205. Therefore, the external air introduced through the second air inlet 205 cools down the components of the control panel 30 as it flows toward the first communication opening 143, as explained later.

In addition, a dividing plate 145 is formed on a rear end of the supporting plate 140. In more detail, the dividing plate 145 extends upward from the rear end of the supporting plate 140 to closely contact an undersurface of the top plate 201. In the embodiment, the dividing plate 145 may be formed by bending the rear end portion of the supporting plate 140 upward. However, the present disclosure is not limited to this configuration. That is, a separate plate may be fixed on the rear end of the supporting plate 140 as the dividing plate 145.

According to the above-described structure, the dividing plate 145 functions to separate (or isolate) the first and second passages P1 and P2 from each other. That is, the first passage P1 is formed extending in a front-rear direction of the electric oven and the second passage P2 is formed extending in a lateral direction of the electric oven by the dividing plate 145. The dividing plate 145 prevents the air flowing along the first passage P1 from backing up toward the second passage P2.

Further, a variety of components such as a high voltage transformer 147 and a relay substrate 149 may be installed on a top surface of the supporting plate 140. Therefore, the components installed on the top surface of the supporting plate 140 are cooled down by the air flowing along the second passage P2.

In addition to the first communication opening 143 is provided on a side of the supporting plate 140, it is noted that a first communication opening 145*a* may be provided on a predetermined position of the dividing plate 145. Further, it is noted that a couple of first communication openings 143,145*a* may be provided on a side of the supporting plate 140 and a predetermined position of the dividing plate 145 as well.

A third passage P3 is defined between the first back plate 123 and the second back plate 133. An upstream side of the third passage P3 is connected to the downstream side of the first passage P1 through the second communication openings 137. Therefore, the air flowing along the first passage P1 flows downward along the third passage P3.

Further, a fan assembly 150 is installed on a rear end portion of the second upper plate 131. The fan assembly 150 generates an air current so that the air can flow along the first to third passages P1, P2, and P3 and a door cooling passage P4 that will be described later. The fan assembly 150 includes a fan motor 151 and a fan 153 that is driven by the fan motor 151. In the embodiment, an air inlet of the fan 153 is oriented frontward and an air outlet of the fan 153 is oriented to communicate with one of the second communication openings 137.

In addition, the airflow in the electric oven by the fan assembly 150 will be described hereinafter.

The air ascending along the door cooling passage P4 passes through the first air inlet 113 to flow rearward along the first passage P1. The external air introduced through the second air inlet 205 flows along the second passage P2 and passes through the first communication opening 143. The external air passing through the first communication openings 143 is joined together at the first passage P1. The joined air flows along the first passages P1 and passes through the second communication opening 137. Subsequently, the air flows downward along the third passage P3. Although not shown in the drawing, the third passage P3 may be connected to a passage formed on an undersurface of the cavity 10. Therefore, the air flowing along the third passage P3 may be exhausted frontward from the electric oven.

Meanwhile, the control panel 30 is installed on an upper end portion of a front portion of the cavity 10. In more detail, the control panel 30 includes a control casing 31 defining an exterior of the control panel 30, a control plate 33 installed in the control casing 31, and a main printed circuit board 35 and a display printed circuit board 37 that are installed on the control plate 33. The plurality of electric components for controlling the operation of the electric oven are mounted on the main printed circuit board 35. A plurality of electric components for displaying a variety of information on the operation of the electric oven are mounted on the display printed circuit board 37. The main printed circuit board 35 and the display printed circuit board 37 are installed on left and right portions of a back surface of the control plate 33. Further, the main printed circuit board 35 and the display printed circuit board 37 are exposed to the second passage P2. Therefore, the main printed circuit board 35 and the display printed circuit board 37 are cooled down by the air flowing along the second passage P2.

Further, the door 40 functions to not only selectively open and close the cooking chamber 11 but also prevent the heat generated in the cooking chamber 11 from being transferred to the external side of the door. To realize this, the door 40 includes a door panel 410, a front glass 420, a doorframe 430, an inner glass 441, an insulation plate, and a door handle 480.

Figure 2:
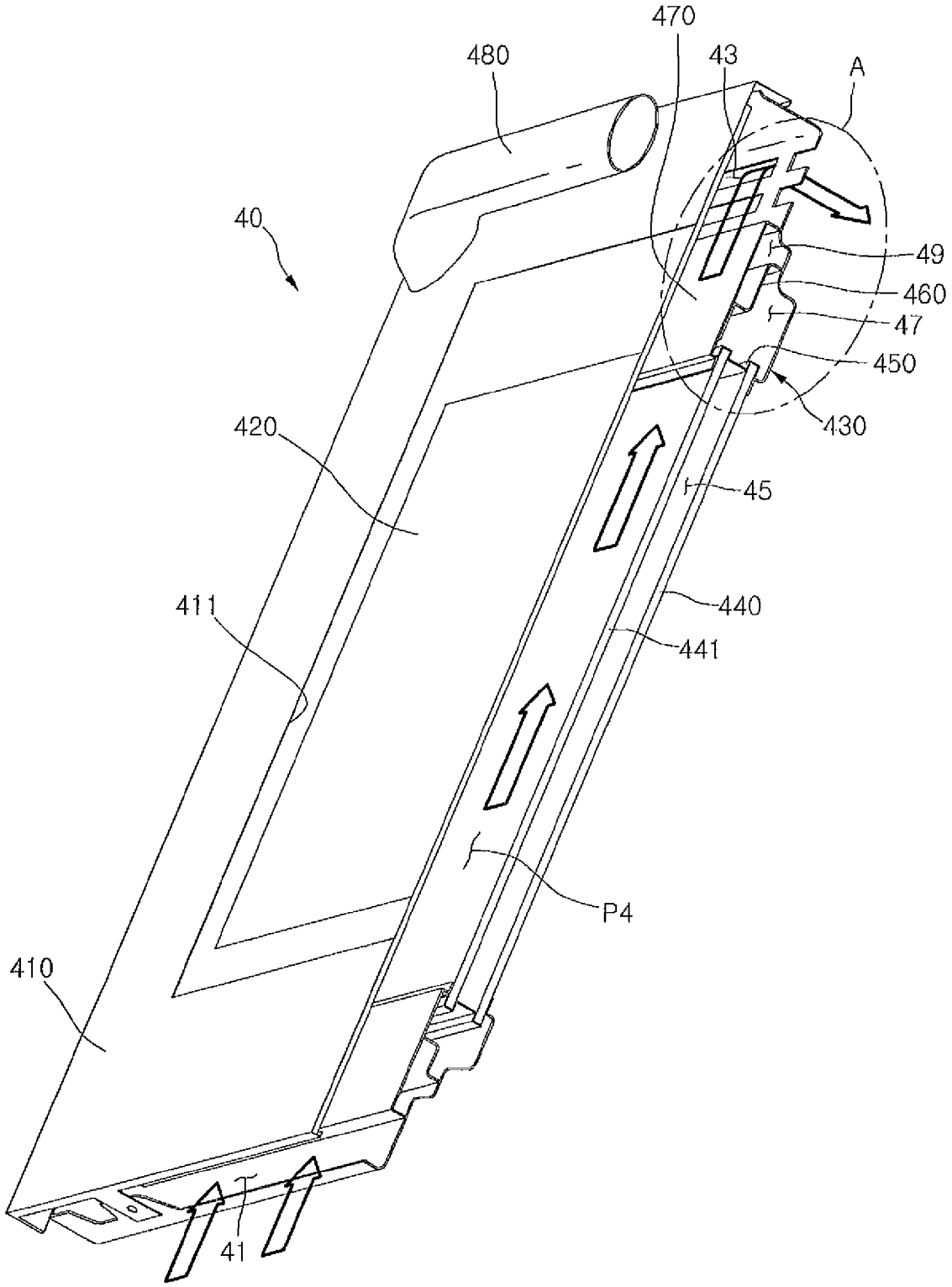
FIG. 2 is a partially cut-away perspective view of the electric oven of FIG. 1.
Figure 3:
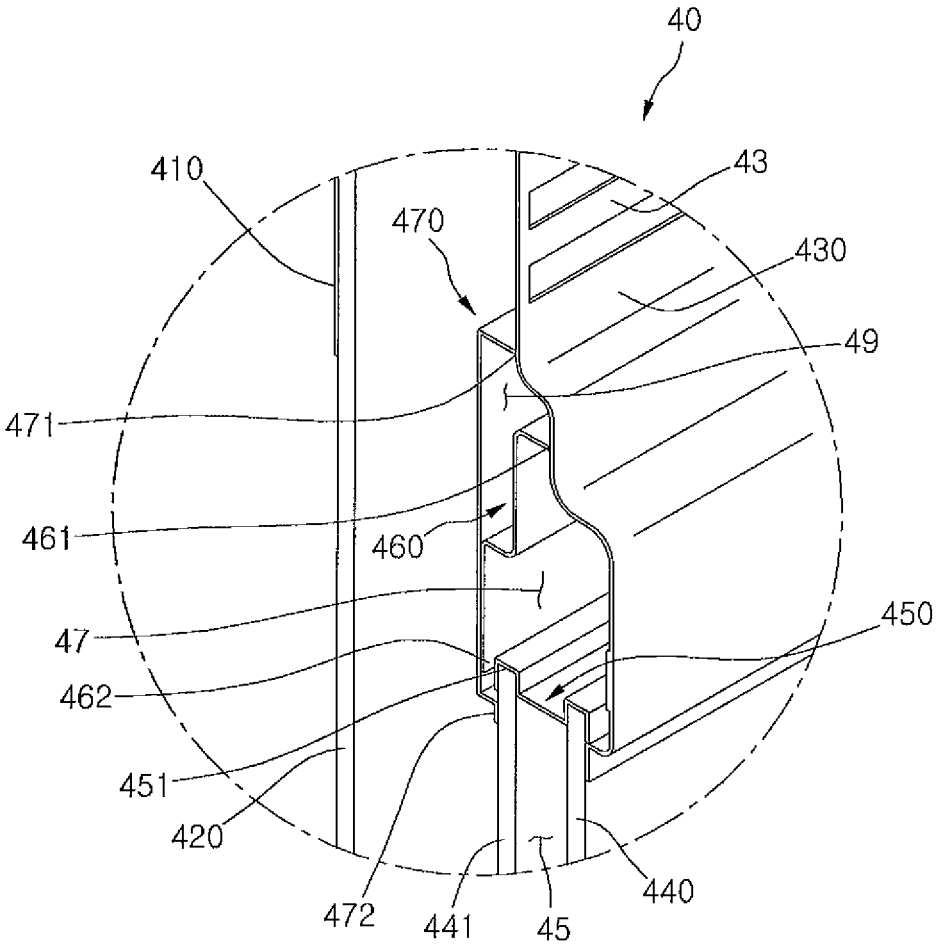
FIG. 3 is an enlarged view of a portion A of FIG. 2.

FIG. 2 is a partially cut-away perspective view of the electric oven of FIG. 1, and FIG. 3 is an enlarged view of a portion A of FIG. 2.

Referring to FIGS. 2 and 3, the door panel 410 defines front, top, and both side surfaces of the door 40. A window 411 is formed in the door panel 410. The window 411 is formed to allow a user to identify a cooking state of the food in the cooking chamber 11. The front glass 420 closely contacts a rear surface of the door panel 410 to cover the window 411. That is, the front glass 420 shields the window 411 of the door panel 410 to substantially define a portion of the front portion of the door 40.

The doorframe 430 defines a rear frame of the door 40. The doorframe 430 is formed in a same rectangular shape as the door 40. The inner circumference of the doorframe defines an opening having a same size as the window 411.

As described above, the door air outlet 43 is formed on a rear surface of the door 40, i.e., a top surface of the doorframe 430. The air ascending along the inside of the door 40 is exhausted to the first passage P1 through the door air outlet 43. The door air outlet communicates with the first air inlet 113 when the door 40 closes the cooking chamber 11.

The rear glass 440 closes the opening defined by the inner circumference of the doorframe 430 and defines a portion of the exterior of the inner surface of the door 40. To realize this, the rear glass 440 is provided on a front surface of the doorframe 430.

The inner glass 441 is defined between the front and rear glasses 420 and 440. Therefore, an inner space between the front and rear glasses 420 and 440 is divided into front and rear spaces by the inner glass 441.

Peripheral portions of the inner and rear glasses 441 and 440 are supported by a glass pack 450. In more detail, the glass pack 450 is provided with insertion grooves 451 in which the inner and rear glasses 4410 and 440 are inserted. The insertion grooves 451 are spaced apart from each other.

An insulation plate is provided in front of the doorframe 430 to form an insulation layer on the Peripheral portions of the glasses 440 and 441. Further, the insulation plate includes a first insulation plate 470 and a second insulation plate 460 provided on an inner side of the first insulation plate 470.

An outer peripheral portion 471 of the first insulation plate 470 is attached to the doorframe 430 and an inner peripheral portion of the first insulation plate 470 is attached to the front surface of the inner glass 441. Further, an outer peripheral portion 461 of the second insulation plate 460 is attached to the front surface of the doorframe 430 and an inner peripheral portion 462 of the second insulation plate 460 closely contacts the rear surface of the first insulation plate 470. At this point, the outer peripheral portion 461 of the second insulation plate 460 is disposed below the outer peripheral portion 471 of the first insulation plate 470 at a predetermined interval. As shown in the drawings, the second insulation plate 460 is bent at three locations so that a part of the second insulation plate 460 can surface-contact the rear surface of the first insulation plate 470. However, the second insulation plate 460 is not limited to this configuration. For example, the second insulation plate 460 can be bent at only two locations so that the inner peripheral portion 462 can approximately line-contact the rear surface of the first insulation plate 470.

The insulation layer is defined between the first insulation plate 470 and the doorframe 430 and the second insulation plate 460 is inserted in the insulation layer. Therefore, the insulation layer is divided into first and second insulation layers 47 and 49. As a result, the transferring of the heat generated in the cooking chamber to the external side is remarkably reduced.

Further, a space defined in the door 40 is divided into the door cooling passage P4 formed between the front glass 420 and the inner glass 441, a main insulation layer 45 formed between the inner glass 441 and the rear glass 440, and a sub-insulation layer formed in front of the doorframe 430. Here, the sub-insulation layer includes the first and second insulation layers 47 and 49 that are formed on the peripheral portions of the inner and rear glasses 441 and 440.

In addition, the door handle 480 is provided on a front-upper end portion of the door panel 410 corresponding to a portion above the window 411 of the door panel 410. The door handle 480 is a portion the user grasps to open and close the door 40.

Meanwhile, a lower end portion of the door cooling passage P4 communicates with the door air inlet 41 formed on the undersurface of the door 40. An upper end portion of the door cooling passage P4 communicates with the door air outlet 43. Therefore, the air introduced through the door air inlet 41 ascends along the door cooling passage P4 and is exhausted through the door air outlet 43.

Further, the main insulation layer 45 is formed by the rear glass 440, inner glass 441, and glass pack 450. The first and second insulation layers 47 and 49 are respectively formed on the front surface of the doorframe 430 and along the peripheral portions of the inner and rear glasses 441 and 440. In addition, the second insulation layer 49 may be formed above the first insulation layer 47 by the second insulation plate 460.

By the sub-insulation layer structure, the transferring of the heat to the external side of the door 40 via the peripheral portions of the glasses 440 and 441 and the door frame 430 can be minimized.

Figure 4:
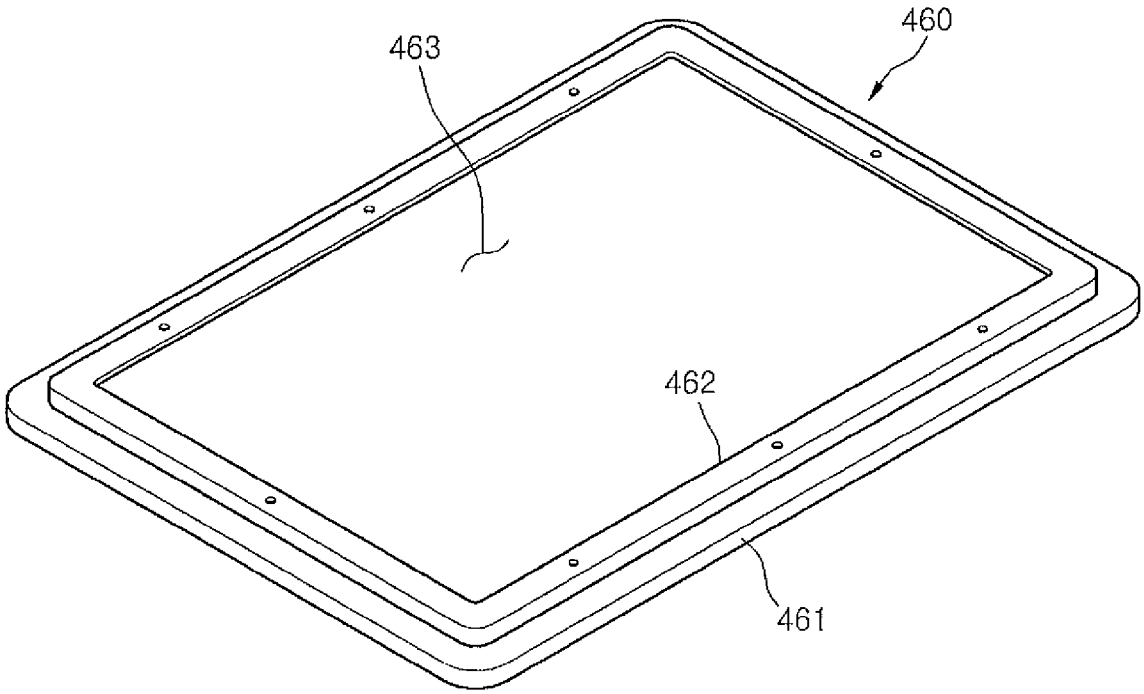
FIG. 4 is a front perspective view of a second insulation plate illustrated in FIGS. 1 and 2.

FIG. 4 is a front perspective view of the second insulation plate.

Referring to FIG. 4, the second insulation plate 460 is formed in a rectangular shape and provided with an opening 463 defined by an inner circumference.

In more detail, an outer peripheral 461 of the second insulation plate 460 closely contacts the front surface of the door frame 430 and an inner peripheral portion 462 of the second insulation plate 460 closely contacts the rear surface of the first insulation plate 470. The second insulation plate 460 partly surface-contacts the first insulation plate 470 depending on its shape. As previously described, the inner peripheral portion 461 may line-contact the first insulation plate 470.

The following will describe the operation of the door of the electric oven in more detail.

First, when a user input manipulation signals through the control panel 30, the electric oven operates in accordance with the input manipulation signals to cook the food loaded in the cooking chamber. That is, the upper heater 115 and/or the convection unit 117 are driven to heat the food in the cooking chamber 11. In addition, when the electric oven operates, the fan assembly 150 is driven to generate air current in the electric oven.

In more detail, when the fan assembly 150 is driven, external air is introduced into the door cooling passage P4 through the door air inlet 43. Further, the external air is further introduced into the second passage P2 through the second air inlet 205. The air introduced to the second passage P2 is directed to the first passage P1 through the first communication opening 143. The air introduced into the door cooling passage P4 is exhausted to the first passage P1 through the door outlet 43 and the first air inlet 113. The air introduced into the first passage P1 is directed to the third passage P3 through the second communication openings 137 by the fan assembly 150.

Meanwhile, moisture and/or oil is generated in the course of cooking the food in the cooking chamber 11. The moisture and/or oil is exhausted together with the air in the cooking chamber 11 to the first passage P1 through the openings 135 formed on the first and second upper plates 121 and 131 by the fan assembly 150 and is then directed together with the air flowing along the first passage P1 to the third passage way P3.

Meanwhile, the air introduced into the second passage P2 through the second air inlet 205 cools down not only the components of the control panel but also the high voltage transformer 147 and relay substrate 149 that are installed on the top surface of the supporting plate 140 as it flows along the second passage P2.

Here, the second passage P2 is completely isolated from the first passage P1 by the dividing plate 145 and communicates with the first passage P1 only through the first communication opening 143. Therefore, an airflow rate in the second passage P2 increases and thus the electric components and the control panel components can be quickly cooled down.

Figure 5:
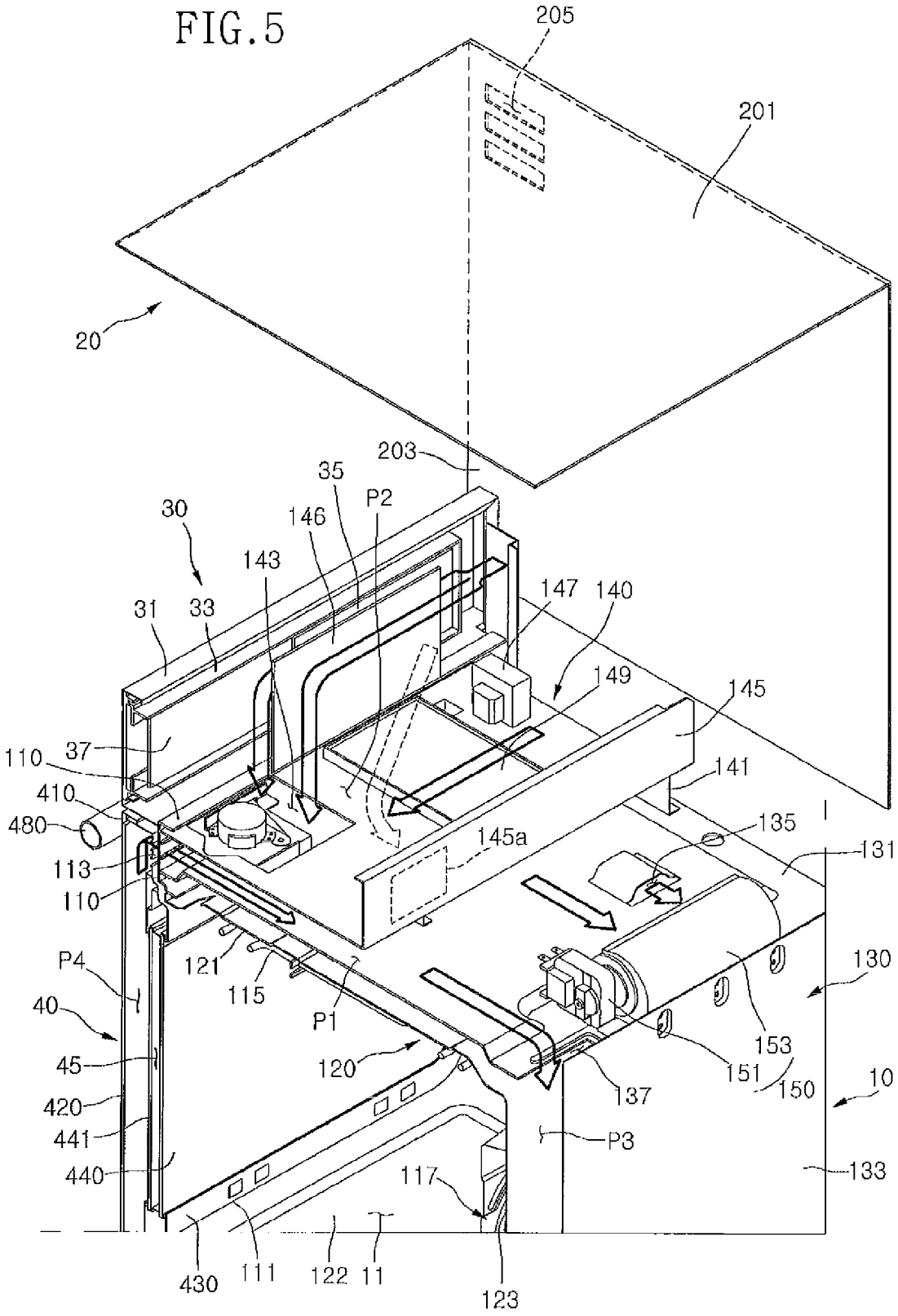
FIG. 5 is an exploded perspective view illustrating an internal structure of an electric oven according to another embodiment.

FIG. 5 is an exploded perspective view illustrating an internal structure of an electric oven according to a second embodiment.

In the first and second embodiments, like reference numbers will be used to refer to like parts, a description of which will be omitted herein.

Referring to FIG. 5, according to this second embodiment, the second passage P2 is further divided into a control panel side passage and an electric component side passage.

In more detail, an air guide 146 may be provided in the second passage P2. That is, the air guide 146 may be disposed along an airflow direction in the second passage P2 and spaced apart rearward from the control panel 30.

The air guide 146 allows the air introduced into the second passage P2 through the second air inlet 205 to be divided to flow along an electric component region defined on a top surface of the supporting plate 140 and the component region of the control panel 30. Accordingly, the components installed on the top surface of the supporting plate 140 and the components of the control panel 30 can be more effectively cooled down.

In more detail, the air guide 146 has a length extending in the airflow direction in the second passage P2, i.e., in a left-right direction of the electric oven. Therefore, a part of the air introduced into the second passage P2 through the second air inlet 205 is used to cool down the high voltage transformer 147 and the relay substrate 149 and is subsequently directed to the first passage P1 through the first communication opening 143. The rest of the air introduced into the second passage P2 through the second air inlet 205 is used to cool down the main printed circuit board 35 and the display printed circuit board 37 and is subsequently directed to the first passage P1 through the first communication opening 143.

As described in FIG. 1, another first communication opening 145*a* may be formed on a predetermined position of the dividing plate 145, instead of the first communication opening 143 is formed on a side edge of the supporting plate 140. Furthermore, a couple of first communication openings 143, 145*a* may be respectively formed on the supporting plate 140 and the dividing plate 145 as well.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

For example, in the embodiments, although the external air is exemplarily introduced through the door air inlet 41 and the second air inlet 205, the present disclosure is not limited to this configuration. That is, the external air may be introduced through a gap formed by an assembling line of the outer case 20 defining the exterior of the electric oven.

What is claimed is:

1. An electric oven, comprising:

an outer case having an external air inlet, the external air inlet formed at a side portion of the outer case;

a cavity enclosed by the outer case and defining a cooking chamber therein, the cavity including:

an inner cavity comprising an upper plate, a bottom plate, side plates and a back plate to define top, bottom, both side and rear surfaces of the cooking chamber; and an outer cavity enclosing the inner cavity and spaced apart from the inner cavity, the outer cavity comprising an upper plate, a bottom plate, side plates and a back plate to define top, bottom, both side and rear surfaces thereof;

a supporting plate horizontally disposed between the upper plate of the outer cavity and the outer case, such that a first passage is established below the supporting plate in a front-to-rear direction of the oven and a second passage is established above the supporting plate, wherein a communication opening is formed at a side edge portion of the supporting plate;

a door for opening or closing a frontal opening of the cavity, the door including a front glass, an inner glass and a door cooling passage between the front glass and the inner glass, the door cooling passage having an air inlet formed in a bottom end of the door and an air outlet formed in an upper end of the door, the door cooling passage configured to communicate with the first passage;

at least one electrical component placed on an upper surface of the supporting plate;

a control panel mounted on front end portions of the cavity and the outer case; and a dividing member for isolating the second passage from the first passage, wherein the dividing member is configured to extend upwardly from a rear end of the supporting plate, such that the second passage extends in a lateral direction of the oven, wherein the communication opening is formed on an opposite side to the external air inlet of the outer case, such that external air flows in the lateral direction from the external air inlet to the communication opening along the second passage, and wherein a third passage is formed between the back plate of the outer cavity and the back plate of the inner cavity.

2. The electric oven according to claim 1, wherein peripheral portions of the supporting plate and dividing member closely contact an inner circumference of the outer case.

3. The electric oven according to claim 1, further comprising a guide member vertically installed above the supporting plate to divide external air introduced into air flowing along a control panel region and air flowing along an electric component region.

4. The electric oven according to claim 3, wherein the guide member extends in a left-right direction of the cavity.

5. The electric oven according to claim 3, wherein the guide member is provided at a location spaced apart from the control panel installed in front of the cavity so that a first part of external air introduced cools the control panel and a second part cools the at least one electrical component installed on the supporting plate.

6. The electric oven according to claim 3, wherein the guide member extends from the external air inlet to a communication opening in the supporting plate.

7. The electric oven according to claim 1, wherein air exhausted from the cavity flows along the first passage and air introduced from an external side flows along the second passage.

8. The electric oven according to claim 1, further comprising a communication opening in the dividing plate.

* * * * *